US007677755B2

(12) United States Patent
Kim

(10) Patent No.: US 7,677,755 B2
(45) Date of Patent: Mar. 16, 2010

(54) VARIABLE ORIENTATION APPLIANCE MOUNT

(75) Inventor: Paul Y. Kim, Santa Ana, CA (US)

(73) Assignee: Surefire, LLC, Fountain Valley, CA (US)

( * ) Notice: Subject to any disclaimer, the term of this patent is extended or adjusted under 35 U.S.C. 154(b) by 474 days.

(21) Appl. No.: 11/804,067

(22) Filed: May 16, 2007

(65) Prior Publication Data

US 2008/0283709 A1 Nov. 20, 2008

(51) Int. Cl.
*F21L 4/00* (2006.01)

(52) U.S. Cl. ..... 362/190; 362/191

(58) Field of Classification Search ..... 248/346.03, 248/346.06, 346.07; 362/110, 113, 114, 362/119, 120, 190, 191, 202, 208, 396; 42/111, 42/124, 125; 224/271, 448
See application file for complete search history.

(56) References Cited

U.S. PATENT DOCUMENTS 2,601,613 A * 6/1952 Jahncke ..... 248/229.15
2,632,251 A 3/1953 Weaver
3,750,318 A * 8/1973 Burris ..... 42/127
4,328,624 A 5/1982 Ross
5,086,566 A * 2/1992 Klumpp ..... 42/126
5,590,484 A 1/1997 Mooney et al.
5,787,630 A * 8/1998 Martel ..... 42/125
5,826,363 A 10/1998 Olson
6,508,027 B1 1/2003 Kim
6,622,416 B2 9/2003 Kim
6,675,521 B1 1/2004 Kim
6,732,987 B2 * 5/2004 Wooten et al. ..... 248/229.1
6,895,708 B2 5/2005 Kim et al.
6,951,409 B2 * 10/2005 Hsien ..... 362/191
6,994,449 B2 2/2006 Kim
7,117,624 B2 10/2006 Kim
7,226,183 B2 * 6/2007 Galli et al. ..... 362/191
7,325,352 B2 * 2/2008 Matthews et al. ..... 42/85

OTHER PUBLICATIONS

United States Department of Defense, Military Standard: Dimensioning of Accessory Mounting Rail for Small Arms Weapons, MIL-STD-1913, Feb. 3, 1995.
Surefire, LLC, "Surefire Tactical Products 2005" catalog, pp. 27 and 28, Feb. 2005.

* cited by examiner

*Primary Examiner*—Hargobind S Sawhney
(74) *Attorney, Agent, or Firm*—David Weiss

(57) ABSTRACT

A mount for securing an appliance such as a light beam generator to a support or other object at various selected orientations of the appliance. A preferred embodiment of the mount includes a circular element having a wedge-shaped circumferential portion and a plurality of rotationally spaced diametric grooves, and a securement device including first and second opposed surfaces for securingly engaging the circular element's wedge-shaped circumferential portion, the securement device including a bar extending between the first and second opposed surfaces for engaging a selected one of the diametric grooves.

19 Claims, 2 Drawing Sheets

VARIABLE ORIENTATION APPLIANCE MOUNT

BACKGROUND OF THE INVENTION

This invention relates to mounts for securing a device to an object, and more particularly to a mount for securing an appliance such as a flashlight to a support or other object at various selected orientations of the appliance.

Appliances such as light beam generators, including flashlights and laser beam devices, have long been adapted for being secured to longitudinal rails on firearms. Such appliances are either equipped with a securement device for mounting engagement with the rail, or the appliance may be secured to an intermediate or interface securement device which in turn may be mounted to the rail. Such longitudinal rails are well known in the firearms art, including a longitudinal rail commonly known as a Picatinny rail and a longitudinal rail commonly known as a Universal rail, comprising a series of longitudinally spaced-apart ribs having wedge-shaped ends and separated by transverse slots. Examples of such longitudinal rails are disclosed in U.S. Pat. Nos. 6,508,027 and 6,622,416, both issued to Paul Y. Kim and incorporated herein by reference.

A device for securement to such longitudinal rails typically includes a pair of longitudinal members having opposed V-shaped surfaces for matingly engaging the wedge-shaped surfaces of the longitudinal rail, and a bar transversely extending between the pair of V-shaped surfaces. The operator places the securement device to the longitudinal rail with the device's V-shaped surfaces engaging the rail's wedge-shaped surfaces and with the device's transverse bar inserted in a selected one of the rail's transverse slots for locking the securement device in a desired longitudinal location on the longitudinal rail.

SUMMARY OF THE INVENTION

The present invention preferably utilizes securement devices typically used with longitudinal rails such as Picatinny or Universal rails. However, the present invention does not utilize a longitudinal rail but instead provides a grooved circular mount which may be secured to a support or other object, and to which the V-shaped surfaces and transverse bar of the securement device may be applied for securely mounting such securement device—or an appliance secured to or integral with the securement device—to the circular mount and hence to the support or other object. In its preferred embodiment, the circular mount includes a plurality of rotationally spaced diametric grooves for being selectively engaged by the transverse bar of the securement device, for permitting the securement device and hence the appliance to be mounted to the object at various selected orientations.

According to one aspect of the present invention, there is provided apparatus for mounting a device to an object, comprising: a mount adapted for being removably secured to the object, the mount including a circular element having a wedge-shaped circumferential portion and at least one diametric groove; and a device including first and second opposed surfaces for securingly engaging the circular element at the wedge-shaped circumferential portion, the device including a bar extending between the first and second opposed surfaces for engaging the at least one diametric groove. The at least one diametric groove is configured for engageably receiving at least a portion of the bar. The device is preferably adapted for clamping its opposed surfaces to the circular element at such circular element's wedge-shaped circumferential portion.

In the preferred embodiment, the circular element includes a plurality of rotationally spaced diametric grooves, each of which is configured for engageably receiving at least a portion of the bar. The device is preferably adapted for clamping its opposed surfaces to the circular element at the circular element's wedge-shaped circumferential portion when the bar engages a selected one of the diametric grooves.

The device may be adapted for securing an appliance such as a light beam generator thereto, or the device may itself include an appliance such as a light beam generator.

BRIEF DESCRIPTION OF THE DRAWINGS

The novel features believed to be characteristic of the present invention, together with further advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
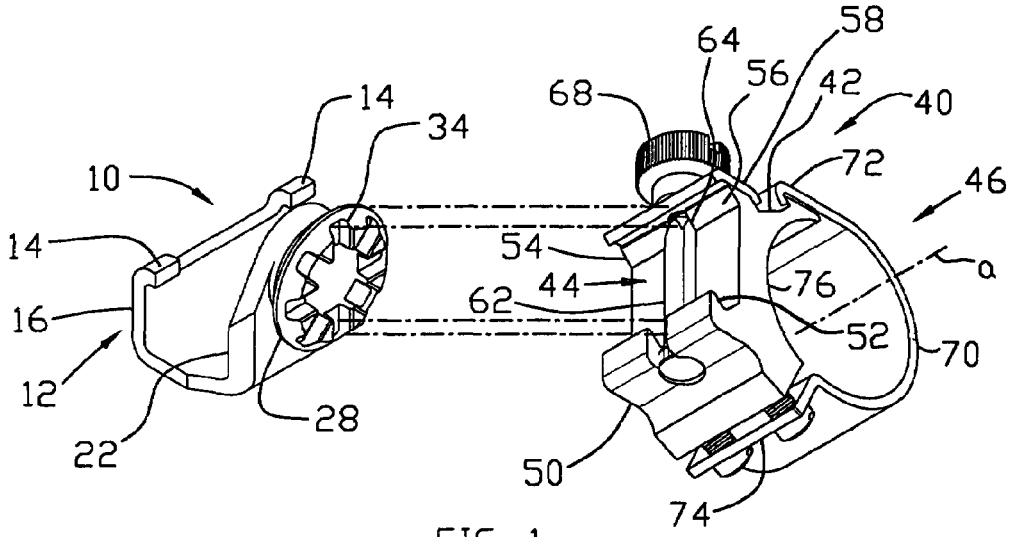
FIG. 1 is a perspective view of a mount for securing a device to an object in accordance with the present invention, shown with an example of a device adapted for being secured to the mount, the mount and device being shown in exploded configuration.

Turning to FIGS. 1-7, a mount 10 comprising a preferred embodiment of the present invention includes a generally U-shaped bracket 12 with two inwardly disposed mounting prongs 14 spaced along a leg 16 of the U. A mounting screw, such as set screw 18, is threadedly disposed in a threaded bore 20 through the opposing leg 22 of the U, the bearing end 24 of the set screw 18 facing the prongs 14 and spaced therefrom so that the bracket 12 may be placed to an object 26 (see FIG. 7)

with the prongs 14 and the set screw 18 on opposite sides of the object 26. Further inwardly threading or tightening of the set screw 18 will cause the bracket 12 to be captured to the object 26 and clampingly secured thereto, and subsequent unthreading or loosening of the set screw 18 will release the securement of the bracket 12 from the object 26.

The mount 10 includes a circular member or element 28 outwardly projecting from the opposed leg 22 of the bracket 12, the circular element 28 having a wedge-shaped circumferential portion 30 outwardly spaced (as by annulus 31) from the outer surface 32 of the opposed leg 22. The threaded bore 20 through the opposing leg 22 continues through and is concentric with the annulus 31 and circular element 28.

The circular element 28 includes at least one groove 34 in its outer surface 36, the groove 34 extending along a diameter of the circular element 28 and into the wedge-shaped circumferential portion 30. The ends of the groove 34 may extend to the circumferential edge 38 of the circular element 28, or the groove 34 may end just short of the circular element's circumferential edge 38, and in either case the groove 34 is referred to herein as a diametric groove.

Preferably, a plurality of such diametric grooves 34 are rotationally spaced apart on the circular element's outer surface 36. For example, a first diametric groove 34*a* is shown vertically oriented as viewed in the drawing of FIG. 4, a second diametric groove 34*b* is clockwise displaced by a rotational angle a from the vertically disposed groove 34*a*, and a third diametric groove 34*c* is clockwise displaced from the second groove 34*b* by a rotational angle β. A fourth diametric groove 34*d* is counterclockwise displaced from the first groove 34*a*, such as by the angle α. If desired, and as preferred in the preferred embodiment, the angular displacements or angles α and β may be equal, and the third diametric groove 34*c* may be horizontally oriented as viewed in the drawing of FIG. 4.

Figure 5:
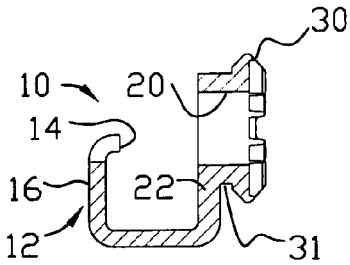
FIG. 5 is a cross-sectional view of the mount of FIG. 1, taken along the line 5-5 of FIG. 2 and viewed in the direction of the appended arrows, the mount being shown without its bracket set screw for clarity.
Figure 6:
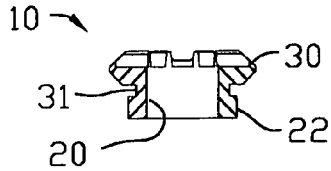
FIG. 6 is a cross-sectional view of the mount of FIG. 1, taken along the line 6-6 of FIG. 4 and viewed in the direction of the appended arrows, the mount of FIG. 6 being shown without its bracket set screw for clarity.

As may be apparent from the cross-sectional profile of the circular element 28 as shown in FIG. 5, the wedge-shaped circumferential portion 30 and the circular element's spacing from the outer surface 32 of the bracket 12, may be similar to the cross-sectional profile of the commonly known Picatinny accessory mounting rail for a firearm described in MIL-STD-1913, and the preferred embodiment of the circular element of the present invention conforms to the Picatinny rail profile. Similarly, the diametric grooves 34 of the preferred embodiment of the present invention may be considered analogous to the recoil grooves provided between the longitudinally spaced-apart ribs of a Picatinny rail, and the width of the diametric grooves 34 may conform to the width of a Picatinny rail recoil groove (approximately 0.206 inch), or to the width of a recoil groove of the commonly known Universal accessory mounting rail (approximately 0.126 inch). In such manner, embodiments of the present invention may be readily adaptable for securing devices thereto that would normally interface with Picatinny or Universal accessory mounting rails. MIL-STD-1913, "Military Standard Dimensioning of Accessory Mounting Rail for Small Weapons", U.S. Department of Defense (3 Feb. 1995) is incorporated herein by reference. An example of a Picatinny rail is described in U.S. Pat. No. 6,895,708 issued to Paul Y. Kim, which patent is incorporated herein by reference.

Figure 7:
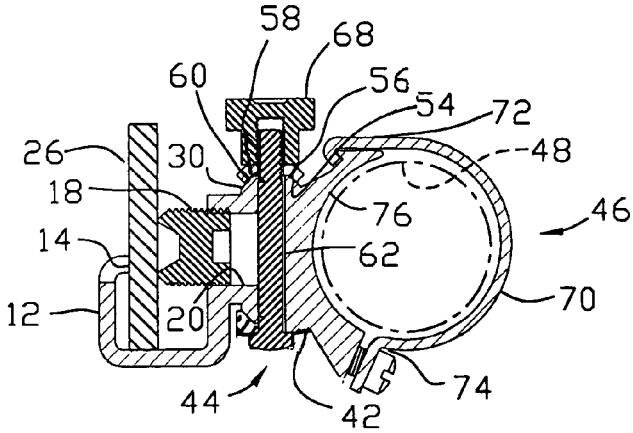
FIG. 7 is a cross-sectional view of the mount as in FIG. 5 but including its bracket set screw, shown secured to an object and to the device shown in FIG. 1, the device shown secured to a further device such as a flashlight or other light beam generator.

Considering FIGS. 1 and 7 in particular, the mount 10 is shown in association with a device 40 adapted for releasable securement to the mount 10. The example of the device 40 shown in FIGS. 1 and 7 is well known in the firearms art, and is of a type that is normally utilized for releasable securement to a Picatinny or Universal accessory mounting rail of a firearm, the specific example shown being marketed by Sure-Fire, LLC (of Fountain Valley, Calif.) under the designation Weaver Mount Model M10.

The device 40 comprises a structural member 42 having a first securement component 44 at one end for being removably secured to the circular element 28, such as by a Weaver style or other clamping mechanism for clampingly cooperating with the wedge-shaped circumferential portion 30 of the circular element 28. A second component 46 at the other end of the device 40 is adapted for securing thereto an appliance 48 such as a light beam generator (including a flashlight or a laser beam apparatus) along a longitudinal axis a.

The first securement component 44 includes a longitudinally extending (i.e., extending parallel to the longitudinal axis a) protrusion 50 having a V-shaped inner surface 52 for tangentially engaging the wedge-shaped circumferential portion 30 of the circular element 28, and further includes an opposing longitudinally extending protrusion 54 having an inclined surface 56 transversely spaced from the V-shaped inner surface 52. A movable member 58 is transversely movable for being retained by the protrusion 54 and includes an inclined surface 60 such that, when the member 58 is transversely moved for engagement with the protrusion 54, the two inclined surfaces 56, 60 are configured as a V-shaped inner surface for tangentially engaging the wedge-shaped circumferential portion 30 of the circular element 28 at a location diametrically opposed to the location at which the V-shaped inner surface 52 of the protrusion 50 tangentially engages the circular element 28. For this purpose, one end of a transverse bar 62 is retained by the protrusion 50, while the other end of the bar 62 extends through an opening 64 in protrusion 54 and through an aperture 66 in movable member 58, such other end threadedly engaging a knurled knob 68 for releasably urging the movable member 58 against the protrusion 54 when the knurled knob 68 is threadably tightened against the movable member 58, thereby releasably clamping the two opposing V-shaped inner surfaces against the wedge-shaped circumferential portion 30 of the circular element 28 at two diametrically opposed locations.

Each of the diametric grooves 34 is configured for engageably receiving at least a portion of the bar 62, so that the width of each of the diametric grooves 34 is slightly greater than the width of the transverse bar 62. During installation of the device 40 to the mount 10, the user selects the orientation of the device 40 (and hence the orientation of the light beam generator 48 secured to the device 40) by selecting one of the diametric grooves 34 of differing orientation, placing the device 40 to the circular element 28 with the protrusions 50 and 54 engaging the circular element's wedge-shaped circumferential portion 30 and with the bar 62 disposed in the selected diametric groove 34, and threadably rotating the knurled knob 68 to urge the moveable member 58 tightly against the outer surface of the protrusion 54 and the inner surface of the circular element's wedge-shaped circumferential portion 30. Loosening rotation of the knurled knob 68 permits the device 40 shown in FIGS. 1 and 7 to be removed from the mount 10.

The second securement component 46 comprises a generally arcuate longitudinally extending shell hinged to the structural member 42 along one longitudinal side 72 and adjustably retained to the structural member 42 along its other side 74. The arcuate shell 70 faces a longitudinally extending arcuate surface 76 of the structural member 42 for securely holding a generally cylindrical portion of an appliance such as the light beam generator 48 along its longitudinal axis a.

Figure 2:
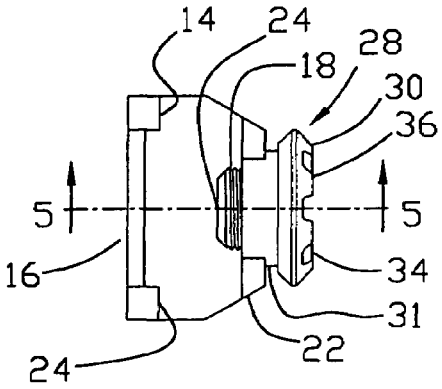
FIG. 2 is a top view of the preferred embodiment of the mount shown in FIG. 1.
Figure 3:
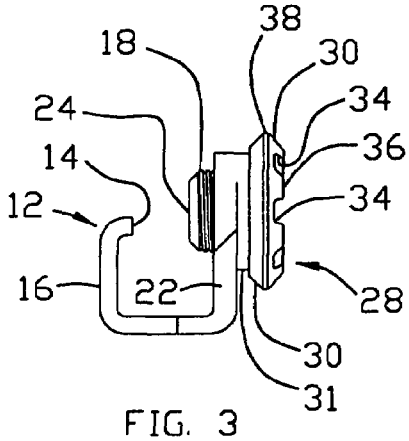
FIG. 3 is a side view of the mount of FIG. 1.
Figure 4:
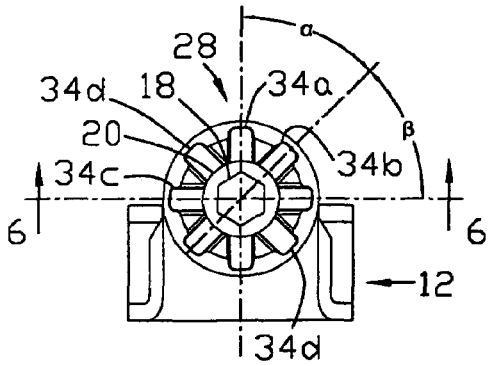
FIG. 4 is a front view of the mount of FIG. 1.

Another example of a prior art device for holding a light beam generator, which device may be used for being clamped to the mount 10 of the present invention, is shown in FIG. 2 of U.S. Pat. No. 6,994,449 issued to Paul Y. Kim, which patent is incorporated herein by reference.

Figure 8:
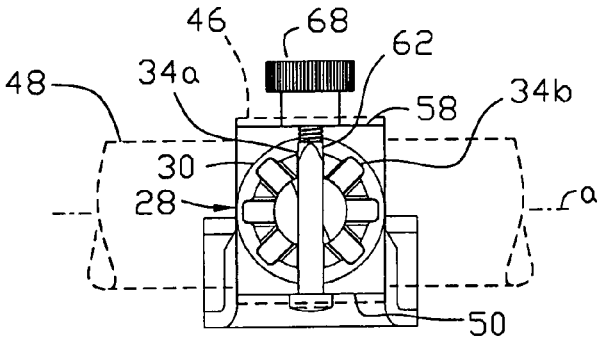
FIG. 8 is a front view of the mount as in FIG. 4, shown with securement components of the device including the light beam generator (partially broken away and/or in phantom) as in FIG. 7, with the securement components and the light beam generator disposed in one orientation on the mount.
Figure 9:
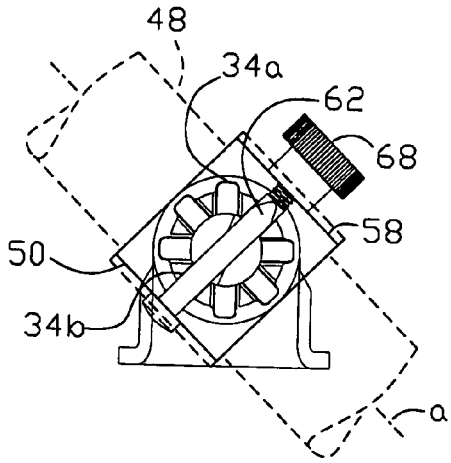
FIG. 9 is similar to FIG. 8, but with the securement components and the light beam generator disposed in a second orientation on the mount.

FIGS. 8 and 9 represent two orientations of the device 40 (and hence of the light beam generator 48 secured thereto) with respect to the mount 10 which in turn may be secured to an object 26 as represented in FIG. 7. The object 26 may be a plate or any other support structure, an example of which may be a rim of a helmet. In FIG. 8, the device 40 is secured to the mount 10 with the bar 62 retained in the vertically disposed diametric groove 34*a* (see FIG. 4), resulting in the light beam generator 48 being horizontally oriented. In FIG. 9, the device 40 is secured to the mount 10 with the bar 62 disposed in the diametric groove 34*b*, resulting in the light beam generator 48 being displaced by the angle a from its orientation represented in FIG. 8. Similarly the device 40 may be secured to the mount 10 with the bar 62 disposed in one of the other grooves 34*c* or 34*d*, resulting in the light beam generator 48*r* being retained in a vertical orientation or in a reverse α-angle displaced orientation, respectively.

The device 40 may be considered as an interface between the mount 10 and an appliance such as the light beam generator 48. It is evident that the combination of such interface and the secured appliance or light beam generator may be considered as an integral device 40 for being secured to the mount 10 of the present invention.

Similarly, the light beam generator or other appliance may itself include a Weaver style or other clamping mechanism, along with a bar mechanism for engaging the diametric grooves 34 of the circular element 28, for directly and removably securing the appliance or light beam generator to the circular element of the mount 10 of the present invention in selected orientations. An example of such an integral appliance, specifically a light beam generator, is described in U.S. Pat. No. 7,117,624, issued to Paul Y. Kim and incorporated herein by reference.

Thus, there has been described a preferred embodiment of a mount for removably securing a device to an object, with the orientation of the device with respect to the object being selectable by a user. Other embodiments of the present invention, and variations of the embodiment presented herein, may be developed without departing from the essential characteristics thereof. Accordingly, the invention should be limited only by the scope of the claims listed below.

I claim:

1. Apparatus for mounting a device to an object, comprising:

a mount securable removably secured to the object, said mount including a circular element having a wedge-shaped circumferential portion and at least one diametric groove; and a device including first and second opposed surfaces for securingly engaging said circular element at said wedge-shaped circumferential portion, said device including a bar extending between said first and second opposed surfaces at least a portion of said bar received by a one of said at least one diametric groove.

2. The apparatus according to claim 1, wherein:

said first and second opposed surfaces extend substantially parallel to a longitudinal axis of said device.

3. The apparatus according to claim 1, wherein:

said device is adapted for clamping said opposed surfaces to said circular element at said wedge-shaped circumferential portion.

4. The apparatus according to claim 1, wherein:

said at least one diametric groove comprises a plurality of rotationally spaced diametric grooves.

5. The apparatus according to claim 4, wherein:

each of said diametric grooves is configured for engageably receiving at least a portion of said bar.

6. The apparatus according to claim 4, wherein:

said first and second opposed surfaces extend substantially parallel to a longitudinal axis of said device.

7. The apparatus according to claim 4, wherein:

said device is adapted for clamping said opposed surfaces to said circular element at said wedge-shaped circumferential portion when said bar engages a selected one of said diametric grooves.

8. The apparatus according to claim 4, wherein:

said diametric grooves are three in number.

9. The apparatus according to claim 4, wherein:

said diametric grooves are rotationally equally spaced.

10. The apparatus according to claim 1, wherein:

said device includes an appliance.

11. The apparatus according to claim 1, wherein:

said device is adapted for securing an appliance thereto.

12. The apparatus according to claim 1, wherein:

said device includes a light beam generator.

13. The apparatus according to claim 1, wherein:

said device is adapted for securing a light beam generator thereto.

14. The apparatus according to claim 4, wherein:

said device includes an appliance.

15. The apparatus according to claim 4, wherein:

said device is adapted for securing an appliance thereto.

16. The apparatus according to claim 4, wherein:

said device includes a light beam generator.

17. The apparatus according to claim 4, wherein:

said device is adapted for securing a light beam generator thereto.

18. The apparatus according to claim 4, including an appliance having a longitudinal axis secured to said device; and wherein said first and second opposed surfaces extend substantially parallel to said longitudinal axis.

19. The apparatus according to claim 18, wherein:

said appliance comprises a light beam generator.

* * * * *

UNITED STATES PATENT AND TRADEMARK OFFICE

CERTIFICATE OF CORRECTION

PATENT NO. : 7,677,755 B2
APPLICATION NO. : 11/804067
DATED : March 16, 2010
INVENTOR(S) : Paul Y. Kim It is certified that error appears in the above-identified patent and that said Letters Patent is hereby corrected as shown below:

At column 5, line 48, "securable removably secured" should be --removably securable--.
At column 6, line 2, --with-- should be inserted after "surfaces".

Signed and Sealed this

Sixth Day of July, 2010

David J. Kappos

David J. Kappos
*Director of the United States Patent and Trademark Office*